United States Patent [19]

Schaumann

[11] Patent Number: 4,459,118

[45] Date of Patent: Jul. 10, 1984

[54] WATER GLIDER ASSEMBLY

[76] Inventor: Peter H. Schaumann, 15 Jasmine La., Port St. Lucie, Fla. 33452

[21] Appl. No.: 321,474

[22] Filed: Nov. 16, 1981

[51] Int. Cl.[3] ..... A63C 15/02

[52] U.S. Cl. ..... 441/76; 441/77

[58] Field of Search ..... 441/76, 77; 308/6 R, 308/3.8; 280/218, 11.15

[56] References Cited

U.S. PATENT DOCUMENTS

| | | | |
|---|---|---|---|
| 1,057,731 | 4/1913 | Halbow | 441/76 |
| 1,384,354 | 7/1921 | Sheldon | 441/77 |
| 1,528,309 | 3/1925 | Steuerlein | 441/77 |

*Primary Examiner*—Trygve M. Blix

*Assistant Examiner*—Ivy M. Shum

*Attorney, Agent, or Firm*—Watson, Cole, Grindle & Watson

[57] ABSTRACT

A water glider assembly includes two water glider members and a separate elongated stabilizer cartridge which can be inserted between the glider members to connect them together and eliminate not only lateral and vertical separations, but also individual sideways rotation of each glider member, while at the same time allow for free parallel movements therebetween. One or the other of the glider members can be partially disconnected from the stabilizer cartridge during use of the assembly so that its direction of orientation can be changed, thereby enabling the user to easily change the direction of movement of the assembly as a whole.

12 Claims, 4 Drawing Figures

WATER GLIDER ASSEMBLY

BACKGROUND OF THE INVENTION

1. Field of the Invention

The present invention relates to water glider assemblies of the type which include separate left and right foot water glider members that can support an individual user above the surface of a body of water and enable the user to move thereacross, and more particularly to such water glider assemblies wherein the separate water glider members are connected together by attachment devices so as to stabilize the assembly.

2. The Prior Art

Water glider members, which are also variously known as water walkers, water shoes, water skis, flotation members and pontoons, are well known elements for use in supporting an individual user above the surface of a body of water and for enabling the user to move from one point to another on the water's surface while standing up. Usually two separate water glider members are used together, one being a left foot water glider member for supporting the left foot and leg of a user and the other being a right foot water glider member for supporting the right foot and leg of the user, and advantageously these separate water glider members are connected together by suitable attachment devices so as to form a water glider assembly which is stable. Without the use of such interconnecting attachment devices it is difficult, and at times unsafe, for a user to stand on the individual glider members or use them to propel himself forward. In this regard, unconnected pairs of glider members will tend to separate laterally due to the fact that the center of gravity of the individual user will be located between the member pairs; they will tend to separate vertically as the weight of the individual user shifts from one glider member to the other during use; and they will individually tend to rotate from side to side, especially when used in rough water conditions. Prior art water glider assemblies have utilized many different types of attachment devices for connecting the water glider member pairs together, some achieving a greater degree of stability in the glider assemblies than others.

Some water glider assemblies siimply utilize flexible connecting lines between the two water glider members. For example, in U.S. Pat. No. 2,694,209 two water skis are connected at their leading and trailing ends by link chains. In U.S. Pat. No. 3,835,494 two water walking pontoons are connected in side by side relationship by a series of elastic chords. However, although these types of water glider assemblies display a certain degree of stability as compared to systems wherein the water glider members are not connected at all, the connecting lines must be relatively short in order to limit the lateral and vertical movements between the glider members, and this shortness in length will likewise limit the relative parallel displacement obtainable between the glider members and thus will reduce their effectiveness in moving an individual user across the water's surface. In addition, the sideways rotation of the separate glider members is not at all effectively controlled.

An improved water glider assembly of the foregoing type is shown in my prior U.S. Pat. No. 4,261,069 wherein two water walker members of a water walker assembly are not only connected by two looped cables but are interengaged by means of an enlarged protrusion which extends outwardly from the side of one of the water walker members to engage in an elongated indentation in the facing side of the other water walker member. However, although this water walker assembly is improved in stability insofar as the positioning of the protrusion in the side of one walker member in the indentation in the other reduces the possible vertical separations between the two glider members and helps to some degree in controlling their individual sideways rotation, the looped cables will by necessity limit the possible relative parallel displacement between the water walker members and thus will limit the ability of the user of the walker assembly to move it forward.

A number of prior art water glider assemblies utilize guide rods which extend in parallel between the individual glider members to provide stability to the assembly. In U.S. Pat. No. 2,153,939 inclined rods are respectively attached to the facing sides of two water skis and loop elements are interconnected between the rods to allow the two skis to be moved in parallel with one another while lateral and vertical separations are prevented. In U.S. Pat. No. 3,112,892 an elongated rod is located in parallel between two skis to fit through slotted projections extending outwardly from the facing sides of the two skis to likewise allow for parallel movement between the two skis while prohibiting lateral and vertical displacements therebetween. However, in neither of these water glider assemblies are the individual glider members fully prevented from individual sideways rotation, and in addition, due to their construction, these assemblies must be either stored and shipped in the form of a single unit (which is cumbersome) or else are assemblable for use only with the help of accessory tools.

Finally, in U.S. Pat. No. 3,877,409 a water glider assembly is shown wherein the individual water skis are connected together by guide rails and cooperating bearing elements which project from facing sides of the two skis, as well as by a separate rod member which is pivotally interconnected to vertically oriented bracket members on the top surface of each ski. However, although this water glider assembly is quite stable because of the fact that the individual skis are limited with respect to lateral and vertical displacements and also because they are prevented from individual sideways rotation, the assembly is quite complicated in structure and requires supplementary equipment in order to control the direction of movement of the glider assembly.

Thus, many of the known water glider assemblies are undesirable because the stabilizing attachment devices used to connect the individual glider members either will be insufficiently effective, undesirably limiting with regard to the parallel displacement between the glider members, undesirably complicated in structure, or difficult to store, transport and assemble. In addition, none of the prior art water glider assemblies are constructed to allow the user to partially disconnect the two individual glider members in order to change the direction of movement of the assembly while in use.

It is thus an object of the present invention to provide a water glider assembly which is stable, i.e., wherein lateral and vertical displacements between the individual water glider members are prevented and wherein sideways rotation of each water glider member is prevented, but which nevertheless allows the individual water glider members to freely move in parallel with respect to one another.

It is a further object of the present invention to provide such a water glider assembly wherein the individual water glider members thereof can be easily redirected in orientation to change the direction of movement of the water glider assembly as a whole.

It is also an object of the present invention to provide a water glider assembly which is simple in construction, easy to store and transport, and readily assembled without the need for accessory tools.

SUMMARY OF THE PRESENT INVENTION

According to the present invention the inventive water glider assembly includes a pair of water glider members and a separate elongated stabilizer cartridge which is connectable between the two water glider members when they are positioned in close side-by-side relationship. The respective water glider members include identical indented steps in their facing sides which extend from their leading ends toward their trailing ends, and mounted in each indented step are a number of guide elements which are constructed to coact with the stabilizer cartridge when inserted therethrough to prevent not only lateral and vertical separation between the water glider members, but also sideways rotation of the individual glider members, while at the same time allow for free parallel movements therebetween. The placement of the guide elements in the indented steps of each glider member will be such as to enable the user of the water glider assembly to disconnect one or the other of the glider members from the rearward end of the stabilizer cartridge while the assembly is being used and thereafter pivot the disconnected glider member with respect to the other glider member about a guide element near its leading end to allow the user to effectively change the direction of movement of the assembly without the need for supplementary equipment attached to either or both of the water glider members.

A further understanding of the invention will be now achieved by reference to the accompanying drawings taken in conjunction with the following discussion.

DETAILED DESCRIPTION OF THE PREFERRED EMBODIMENT

Figure 1:
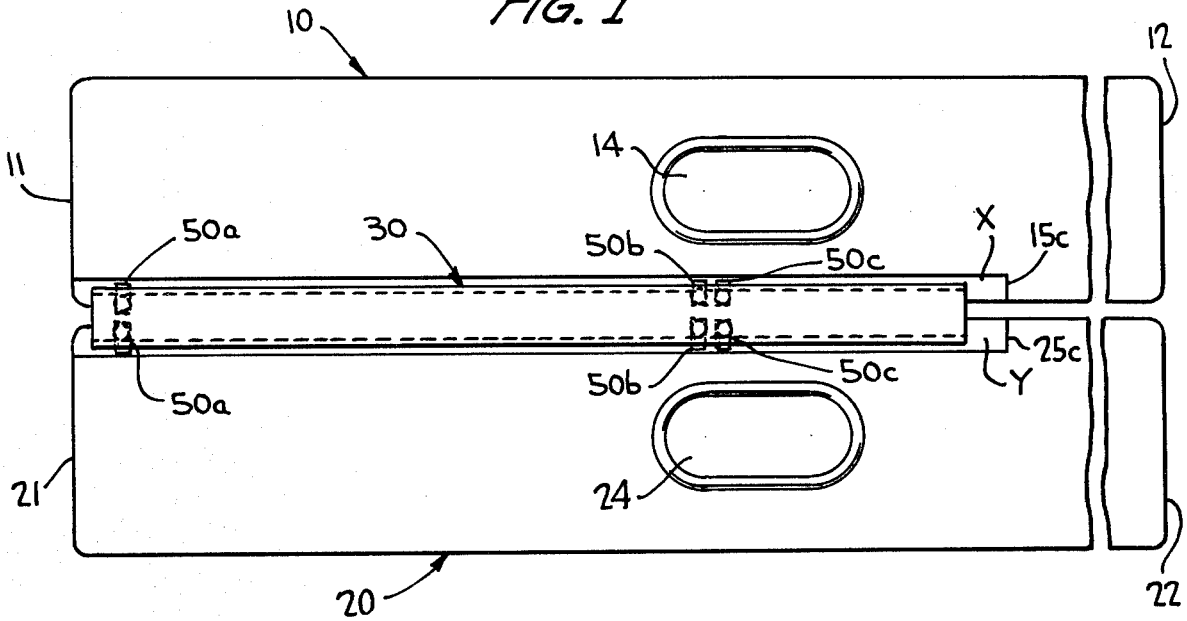
FIG. 1 shows a top plan view of a water glider assembly constructed in accordance with the present invention, the assembly including a pair of water glider members and an interconnecting stabilizer cartridge.

As shown in FIG. 1, the water glider assembly of the present invention includes a right foot water glider member 10, a left foot water glider member 20 and an interconnecting elongated stabilizer cartridge 30. The right foot water glider member is seen to include a leading end 11, a trailing end 12, a top surface 13, a foot cavity 14, and a left side surface 15. The left foot water glider member 20 likewise includes a leading end 21, a trailing end 22, a top surface 23, a foot cavity 24 and a right side surface 25. When the left and right foot water glider members 10 and 20 are positioned next to each other so as to allow the stabilizer cartridge to be inserted (and connected) therebetween, the left side surface 15 of glider element 10 will face the right side surface 25 of glider element 20.

Figure 4:
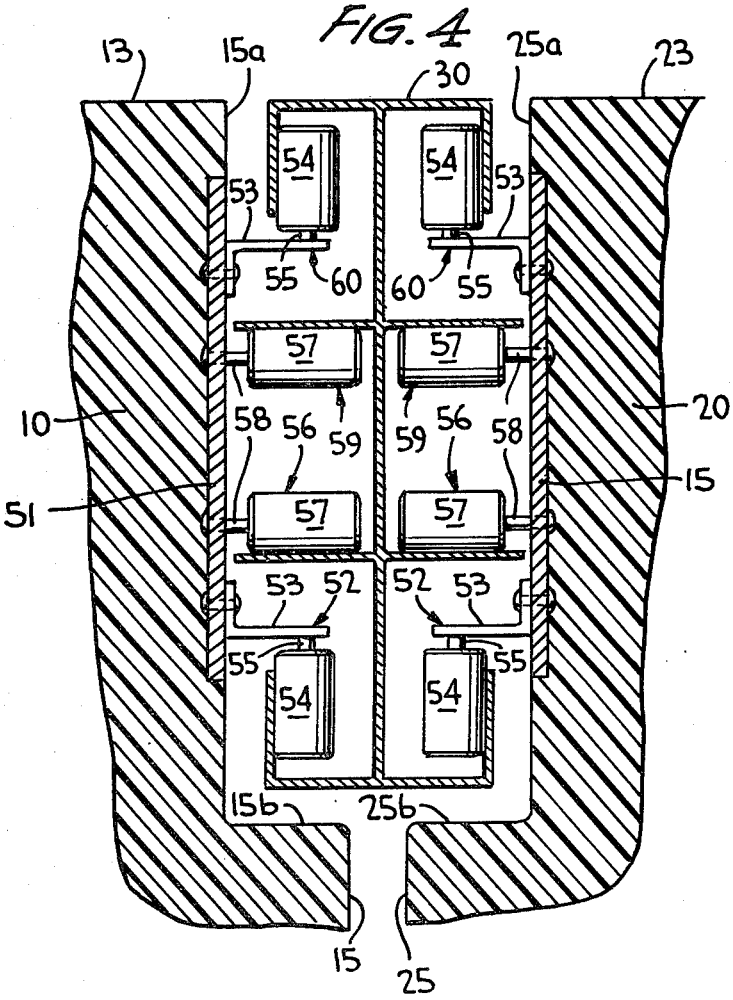
FIG. 4 shows a cross sectional view of the water glider assembly as seen along line 4—4 of FIG. 3.

As best seen in FIGS. 1 and 4, both the left side surface 15 of glider member 10 and the right side surface 25 of glider member 20 are constructed to have indented steps which extend from the respective leading ends 11 and 21 of the glider members to points located rearwardly of the respective foot cavities 14 and 24 (which themselves will be located at about the midway point between the leading ends of the glider members and the trailing ends). The indented steps in the two glider assemblies are formed by respective vertical wall portions **15*a* and 25*a* which extend downwardly from the respective top surfaces 13 and 23, respective horizontal wall portions 15*b* and 25*b*, and rearward wall portions 15*c* and 25*c* (see FIG. 1). The indented steps formed by the wall portions 15*a*, 15*b* and 15*c* in glider member 10 and wall portions 25*a*, 25*b* and 25*c* in glider member 20 create respective elongated channels X and Y along the facing sides of the respective glider members which are open at their forward ends, their tops and their sides and extend from the leading ends 11 and 21 of the respective glider members to their rearward wall portions 15*c* and 25*c***.

Mounted on each of the respective vertical wall portions **15*a* and 25*a* of the glider members 10 and 20 are three identical guide elements 50*a*, 50*b* and 50*c*. Each guide element is dimensioned to fit within the associated channel X or Y, and as shown in FIG. 1 each of the guide elements 50*a* are identically located near the leading ends of the glider members 10 and 20 while the guide elements 50*b* and 50*c*** are identically located near one another at about the midway point between the leading and trailing ends of each glider member.

Referring now to the specific construction of the guide elements, as seen in FIG. 4 each includes a base plate 51, which is mountable on the associated vertical wall portion of the glider member by suitable means (not shown), and four roller assemblies 52, 56, 57 and 60 which are located in spaced apart fashion between the upper and lower ends (as seen in FIG. 4) of the base plate. The lowermost roller assembly 52, which is attached to the base plate 51 near its lower edge (as shown in FIG. 4), includes a mounting bracket 53, a cylindrical roller 54 and a roller shaft 55. The mounting bracket 53, which has an L-shaped cross section, has its foot portion attached to the base plate 51 such that its leg portion extends perpendicularly away from the base plate. One end of the roller shaft 55 is attached to the leg portion of the mounting bracket so as to extend in parallel with the base plate 51 and the cylindrical roller 54 is rotatably mounted on the opposite (free) end of the roller shaft 55 such that it extends downwardly and away from the other roller assemblies. The uppermost roller assembly 60 is identical to the roller assembly 52 except that it is attached to the base plate 51 near its upper edge and is oriented such that its cylindrical roller 54 extends upwardly and away from the other roller assemblies. On the other hand, the two middle roller assemblies 56 and 59, which are identical, include a cylindrical roller 57 and a roller shaft 58. One end of the roller shaft 58 is connected to the base plate 51 to extend perpendicularly away therefrom and the cylindrical roller 57 is rotatably attached to its opposite (free) end.

The roller assemblies of each guide elements are suitably dimensioned and appropriately positioned along between the upper and lower edges of the base plate 51

(as seen in FIG. 4) so as to abut against the cooperating parts of the stabilizer cartridge when it is extended therethrough.

Figure 2:
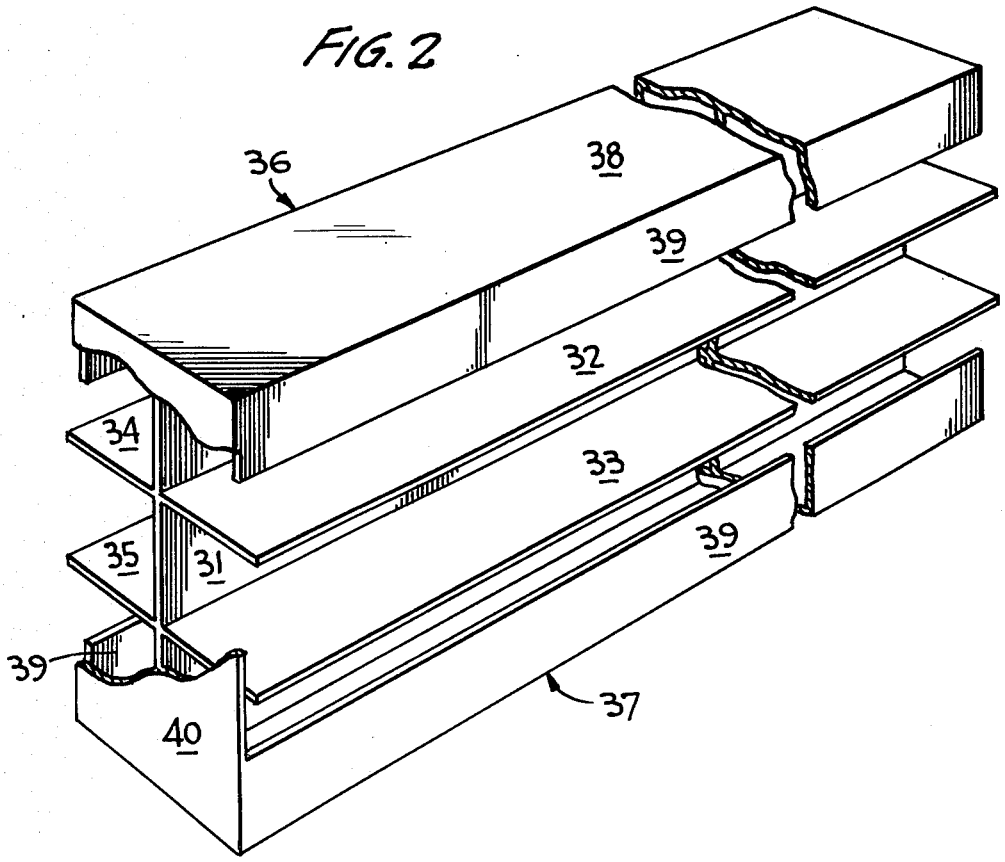
FIG. 2 shows a perspective view, partially broken away, of the stabilizer cartridge shown in FIG. 1.
Figure 3:
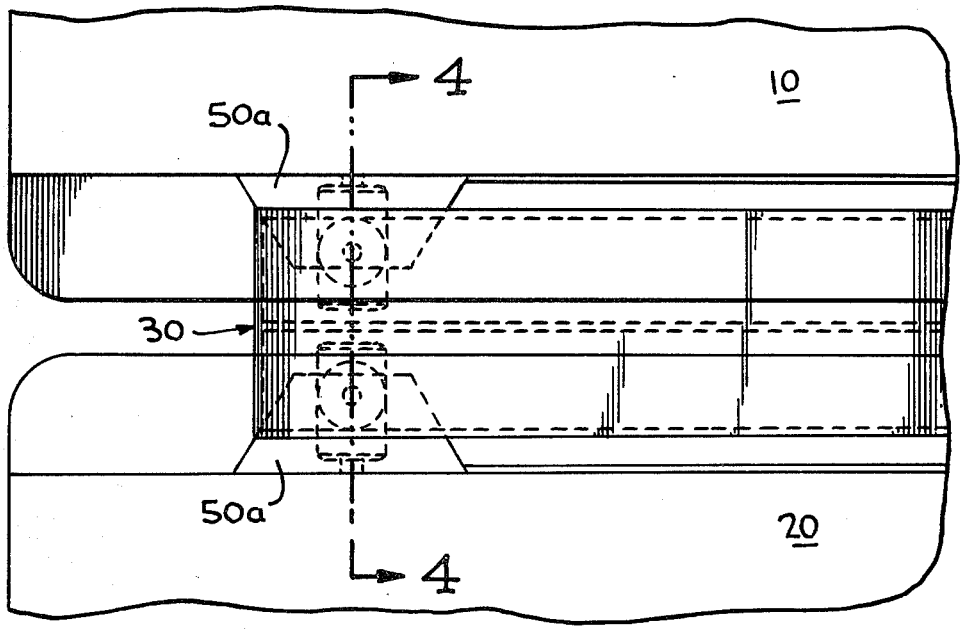
FIG. 3 shows a detailed top view of the structure found in area A of FIG. 1.

Turning now to the structure of the elongated stabilizer cartridge 30, as shown in FIGS. 2 and 4 it is seen to include a flat center member 31, a first pair of flat rib members 32,33 which extend perpendicularly outwardly from one side of the center member 31, a second pair of flat rib members 34,35 which extend perpendicularly outwardly from the opposite side of the center member 31, and two cap members 36,37 which are respectively connected to the upper and lower edges of the center member 31. Each of the cap members includes a flat floor portion 38 and flat flange portions 39 which extend in the same direction perpendicularly away from the opposite side edges of the flat floor portion 38. The cap member 36 is attached to the upper edge (as seen in FIGS. 2 and 4) of center member 31 along the center of the flat floor portion 38 and such that its flange portions 39 extend downwardly towards the rib members 32 and 34. The cap member 37 is correspondingly attached to the lower edge of center member 31 such that its flange portions 39 extend upwardly towards the rib members 33 and 35. The stabilizer element also includes at its front end a flat closure member 40 which is connected to the front ends of all the members 31–39 so as to completely enclose the front end of the stabilizer cartridge. The opposite (rear) end of the stabilizer cartridge is left open.

As can be seen from FIG. 1, the stabilizer cartridge is sufficiently elongated that when inserted between the two glider members 10 and 20, it will extend from the guide elements **50*a* of each glider member rearwardly along channels X and Y to corresponding points behind the guide elements 50*c*. The stabilizer cartridge will cooperate with the guide elements of each glider member such that the cylindrical rollers 53 will be in rolling contact with the inner sides of flat flanges 39 and the cylindrical roller 57 will be in rolling contact with the facing sides of flat rib members 32,33 and 35,36**. Such engagements between the cylindrical rollers of the guide elements and the noted parts of the stabilizer cartridge will completely eliminate not only lateral and vertical displacements between the two glider members but also individual sideways rotation of either glider member, while at the same time allow for free parallel movement therebetween.

In a typical embodiment of water glider assembly constructed in accordance with the present invention the two glider members will be about 60 inches in length, the indented steps along their facing sides will extend rearwardly of their leading ends by about 50 inches and the guide elements will be positioned in the indented steps such that the guide elements **50*a* are about two inches rearwardly of their leading ends while the guide elements 50*b* and 50*c*** are positioned about two inches apart at a point about 30 inches rearwardly of the leading ends. The stabilizer cartridge, which can be constructed of extruded aluminum, will be about 47 inches in length.

The water glider assembly of the invention can be assembled from the individual components as follows: the right and left foot water glider members 10 and 20 are oriented in parallel such that their respective side walls 15 and 25 face one another. Then the stabilizer cartridge is centrally placed in front of the glider members so as to be parallel therewith, the open rear end of the stabilizer cartridge being closest to the glider members. The stabilizer cartridge is then inserted into the channels X and Y of the glider members and sequentially inserted in and through the respective guide elements **50*a*, 50*b* and 50*c* until the flat closure member 40 of the stabilizer cartridge contacts the guide elements 50*a* (see FIG. 2**). The water glider assembly can then be conveyed as a unit to the body of water in which it is to be used and then mounted by the user.

In use, the person who is standing on the individual glider members can move himself along the water's surface by alternately moving his legs forward in a gliding motion so as to move the glider members in parallel with one another. No lateral or vertical separations between the two glider members will occur and neither glider member will separately rotate to cause the user to lose his balance; thus the assembly will be quite stable, even in rough water. The stabilizer cartridge 30 will remain in place by the water pressure exerted on the flat closure member 40. When the user wishes to adjust or reverse his direction of movement, one glider member is moved in parallel with respect to the other sufficiently that the open rear end of the stabilizer cartridge will disengage from the guide elements **50*b* and 50*c* on the rearward glider member and the forward glider member (and stabilizer cartridge) pivoted about the guide element 50*a* on the rearward glider member such that the new direction of movement is determined. The rearward glider member is then swung into alignment with the forward glider member, the rearward glider member is then moved forward such that the stabilizer cartridge is again engaged with its guide elements 50*b* and 50*c***, and the gliding motion of the user's legs renewed.

Finally, it should be noted that various modifications can be made in the described embodiment and still be within the scope of the invention. For example, one or more of the rollers of each guide element can be non-cylindrical in shape, provided that the parts of the stabilizer cartridge which they contact are correspondingly shaped. Indeed, the rollers may be replaced with other bearing devices as long as they will suitably slidingly engage the corresponding parts of the stabilizer cartridge. Further, the base plates of each guide element can be eliminated and the roller assemblies mounted directly onto the vertical wall portions of the indented steps of each glide member. Finally, it should be recognized that the individual water glider members can be constructed to have any desired types of control mechanisms along their bottoms, such as those shown in my U.S. Pat. No. 4,261,069.

I claim:

1. A water glider assembly which is extremely stable and which is constructed such that its direction of movement can be easily changed, said water glider assembly comprising a right foot water glider member which includes a leading end, a trailing end, a top surface and a left side surface; said left side surface including an indented step which forms an elongated channel that extends from the leading end of said right foot water glider member towards its trailing end; said right foot water glider member also including three guide elements attached thereto, each said guide element including at least one roller assembly extending into the elongated channel formed in said right foot water glider member, the first of said three guide elements being located in the indented step of said right foot water glider member near its leading end and the second and third of said three guide elements being located in the indented step close together at a point about halfway between the leading and trailing ends of said right foot water glider member, a left foot water glider member which includes a leading end, a trailing end, a top surface and a right side surface; said right side surface including an indented step which forms an elongated channel that extends from the leading end of said left foot water glider member towards its trailing end; said left foot water glider member also including three guide elements connected thereto, each said guide element including at least one roller assembly extending into the elongated channel formed in said left foot water glider member, the first of said three guide elements being located in the indented step of said left foot water glider member near its leading end and the second and third of said three guide elements being located in the indented step close together at a point about halfway between the leading and trailing ends of said left foot water glider member, and an elongated stabilizer cartridge which is sufficiently elongated such that it can extend along the elongated channels in both said right and left foot water glider members from the first guide members thereof to a point behind the third guide elements thereof and be cooperable with the roller assemblies of the guide elements of both said right and left foot water glider members to prevent lateral and vertical separation thereof and to prevent individual sideways rotation of each glider member, yet allow easy parallel movement of the water glider members by the user when moving himself across the surface of the water in which the assembly is located, said elongated stabilizer cartridge being readily disengageable with the roller assemblies of the guide elements of either the right or left foot water glider member.

2. The water glider assembly as defined in claim 1 wherein the indented step of both the right foot water glider member and left foot water glider member are formed by a vertical wall portion which extends downwardly from the glider member top surface, a horizontal wall portion and a rear end wall portion; and wherein each of said guide elements is mounted on an associated vertical wall portion.

3. A water glider assembly which is extremely stable and which is constructed such that its direction of movement can be easily changed, said water glider assembly comprising a right foot water glider member which includes a leading end, a trailing end, a top surface and a left side surface; said right foot water glider member including a vertical wall portion which extends downwardly from its top surface, a horizontal wall portion and a rear wall portion, said wall portions providing an indented step which forms an elongated channel in the left side surface of said right foot water glider member that extends from the leading end of said right foot water glider member towards its trailing end; said right foot water glider member also including three identical guide elements connected to said vertical wall portion, each said guide element including a base plate and four spaced apart roller assemblies which extend into the elongated channel formed in said right foot water glider member, the first of said three guide elements being located in the indented step of the said right foot water glider member near its leading end and the second and third of said three guide elements being located in the indented step close together at a point about halfway between the leading and trailing ends of said right foot water glider member, a left foot water glider member which includes a leading end, a trailing end, a top surface and a right side surface; said left foot water glider member including a vertical wall portion which extends downardly from its top surface, a horizontal wall portion and a rear wall portion, said wall portions providing an indented step which forms an elongated channel in the right side surface of said left foot water glider member that extends from the leading end of said left foot water glider member towards its trailing end; said left foot water glider member also including three identical guide elements connected to said vertical wall portion, each said guide element including a base plate and four spaced apart roller assemblies which extend into the elongated channel formed in said left foot water glider member, the first of said three guide elements being located in the indented step of said left foot water glider member near its leading end and the second and third of said three guide elements being located in the indented step close together at a point about halfway between the leading and trailing ends of said left foot water glider member, and an elongated stabilizer cartridge which is capable of extending along the elongated channels in both said right and left foot water glider members and is cooperable with the roller assemblies of the guide elements of both said right and left foot water glider members to prevent lateral and vertical separation thereof and to prevent individual sideways rotation of each glider member, yet allow easy parallel movement of the water glider members by the user when moving himself across the surface of the water in which the assembly is located, said elongated stabilizer cartridge being readily disengageable with the roller assemblies of the guide elements of either the right or left foot water glider member.

4. The water glider assembly as defined in claim 3 wherein said four assemblies include two identical upper and lower assemblies and two identical middle roller assemblies.

5. The water glider assembly as defined in claim 4, wherein each of said upper and lower roller assemblies includes an L-shaped mounting bracket, a cylindrical roller and a roller shaft, the foot portion of said L-shaped mounting bracket being connected to said base plate, one end of said roller shaft being connected to the leg portion of said L-shaped mounting bracket such that said roller shaft extends in parallel with said base plate, and said cylindrical roller being rotatably attached to the opposite (free) end of said roller shaft.

6. The water glider assembly as defined in claim 5 wherein each of said middle roller assemblies includes a cylindrical roller and a roller shaft, one end of said roller shaft being connected to said base plate such that the roller shaft extends perpendicularly away therefrom, and the said cylindrical roller being rotatably attached to the opposite (free) end of said roller shaft.

7. The water glider assembly as defined in claim 6 wherein said upper and lower roller assemblies are connected to said base plate such that the cylindrical rollers thereof extend away from the middle roller assemblies.

8. A water glider assembly which is extremely stable and which is constructed such that its direction of movement can be easily changed, said water glider assembly comprising a right foot water glider member which includes a leading end, a trailing end, a top surface and a left side surface; said left side surface including an indented step which forms an elongated channel that extends from the leading end of said right foot water glider member towards its trailing end; said right foot water glider member also including at least two guide elements connected thereto, each said guide element including at least one roller assembly extending into the elongated channel formed in said right foot water glider member, a left foot water glider member which includes a leading end, a trailing end, a top surface and a right side surface; said right side surface including an indented step which forms an elongated channel that extends from the leading end of said left foot water glider member towards its trailing end; said left foot water glider member also including at least two guide elements connected thereto, each said guide element including at least one roller assembly extending into the elongated channel formed in said left foot water glider member, and an elongated stabilizer cartridge which is capable of extending along the elongated channels in both said right and left foot water glider members and is cooperable with the roller assemblies of the guide elements of both said right and left foot water glider members to prevent lateral and vertical separation thereof and to prevent individual sideways rotation of each glider member, yet allow easy parallel movement of the water glider members by the user when moving himself across the surface of the water in which the assembly is located, said elongated stabilizer cartridge being readily disengageable with the roller assemblies of the guide elements of either the right or left foot water glider member, said elongated stabilizer cartridge including a flat center member, two sets of spaced apart flat rib members which extend away from opposite sides of said flat center member, two cap members which are respectively connected to the upper and lower edges of said center member, and a flat closure member connected to one end of said elongated stabilizer cartridge to connect the adjacent ends of each of said center member, said rib members and said cap members.

9. The water glider assembly as defined in claim 8 wherein each of said cap members includes a flat floor portion and flat flange portions which extend in the same direction perpendicularly away from opposite side edges of said flat floor portion.

10. The water glider assembly as defined in claim 9 wherein the cap member attached to the upper edge of said center member is attached thereto along the center line of its floor portion and wherein the flat flanges thereof extend downwardly towards said rib members.

11. The water glider assembly as defined in claim 10 wherein the cap member attached to the lower edge of said center member is attached thereto along the center line of its floor portion and wherein the flat flanges thereof extend upwardly towards said rib members.

12. A water glider assembly which is extremely stable and which is constructed such that its direction of movement can be easily changed, said water glider assembly comprising a right foot water glider member which includes a leading end, a trailing end, a top surface and a left side surface; said left side surface including an indented step which forms an elongated channel that extends from the leading end of said right foot water glider member towards its trailing end; said right foot water glider member also including at least two guide elements connected thereto, each said guide element including at least two roller assemblies extending into the elongated channel formed in said right foot water glider member, a left foot water glider member which includes a leading end, a trailing end, a top surface and a right side surface; said right side surface including an indented step which forms an elongated channel that extends from the leading end of said left foot water glider member towards its trailing end; said left foot water glider member also including at least two guide elements connected thereto, each said guide element including at least two roller assemblies extending into the elongated channel formed in said left foot water glider member, and an elongated stabilizer cartridge which is capable of extending along the elongated channels in both said right and left foot water glider members and is cooperable with the roller assemblies of the guide elements of both said right and left foot water glider members to prevent lateral and vertical separation thereof and to prevent individual sideways rotation of each glider member, yet allow easy parallel movement of the water glider members by the user when moving himself across the surface of the water in which the assembly is located, said elongated stabilizer cartridge being readily disengageable with the roller assemblies of the guide elements of either the right or left foot water glider member, said elongated stabilizer cartridge including a generally vertical center member which has opposite sides, upper and lower edges, and a front end and a rear end, at least one rib member extending away from the respective opposite sides of said center member, at least one cap member connected to one of the upper and lower edges of said center member, and a closure member connected to the front end of said center member.

* * * * *